US009372032B2

(12) United States Patent
Futa

(10) Patent No.: US 9,372,032 B2
(45) Date of Patent: Jun. 21, 2016

(54) COOLING APPARATUS USED IN RECYCLING SCRAP TIRES

(76) Inventor: David M. Futa, South Bend, IN (US)

( * ) Notice: Subject to any disclaimer, the term of this patent is extended or adjusted under 35 U.S.C. 154(b) by 283 days.

(21) Appl. No.: 13/317,867

(22) Filed: Oct. 31, 2011

(65) Prior Publication Data

US 2013/0109293 A1 May 2, 2013

(51) Int. Cl.

| | |
|---|---|
| ***F24F 7/06*** | (2006.01) |
| ***F24F 7/007*** | (2006.01) |
| ***F27D 15/02*** | (2006.01) |
| ***F28C 3/14*** | (2006.01) |

(52) U.S. Cl.

CPC ..... *F27D 15/0286* (2013.01); *F28C 3/14* (2013.01)

(58) Field of Classification Search

CPC .. F26B 17/107; F26B 25/002; F27D 15/0286; B04C 5/08; B04C 5/103

USPC ..... 454/178, 180, 338; 34/62, 65, 66

See application file for complete search history.

(56) References Cited

U.S. PATENT DOCUMENTS 2,276,496 A * 3/1942 Kennedy ..... F27D 15/0286 34/170
2,331,433 A * 10/1943 Crowley, Jr. ..... B01J 8/1881 208/120.01
2,492,132 A * 12/1949 Payne ..... B01J 8/12 165/65
2,555,516 A * 6/1951 Stoneman ..... B01D 1/18 159/4.06
3,833,137 A * 9/1974 Mathews ..... F26B 25/002 222/245
3,837,792 A * 9/1974 Deussner ..... F28C 3/14 432/77
4,067,120 A * 1/1978 Bradford ..... F26B 17/1416 34/169
4,086,708 A * 5/1978 Westelaken ..... F26B 17/1408 34/170
4,152,841 A * 5/1979 Westelaken ..... F26B 25/002 222/274
4,159,580 A * 7/1979 Welch, Jr. ..... F26B 25/06 34/168
4,445,282 A * 5/1984 Heinemans ..... F28C 3/12 222/561
4,624,636 A * 11/1986 Willis ..... F27B 7/383 34/168
4,683,665 A * 8/1987 Geelen ..... F28C 3/12 34/168
4,821,428 A * 4/1989 Good ..... F26B 9/02 34/233
4,869,162 A * 9/1989 Schouten ..... A23K 1/003 34/168
4,887,364 A * 12/1989 Geelen ..... F26B 25/10 34/583
5,375,342 A * 12/1994 Giesler ..... F26B 25/002 34/168
5,791,066 A * 8/1998 Crews ..... B04C 5/08 34/168
5,794,358 A * 8/1998 Robertson ..... F26B 9/063 34/172
5,906,482 A * 5/1999 Tedman ..... F27D 15/0286 432/77
5,915,814 A * 6/1999 Crews ..... B04C 5/08 34/166
6,158,145 A * 12/2000 Landon ..... F26B 17/107 34/364
6,202,319 B1 * 3/2001 Bening ..... F26B 17/122 34/165
6,421,931 B1 * 7/2002 Chapman ..... F26B 17/04 34/210
7,568,297 B2 * 8/2009 Pierson ..... F26B 9/103 219/697
8,567,086 B2 * 10/2013 Kanai ..... F26B 17/24 34/102

* cited by examiner

*Primary Examiner* — Steven B McAllister
*Assistant Examiner* — Jonathan Cotov
(74) *Attorney, Agent, or Firm* — Phillips Lytle LLP; David L. Principe

(57) ABSTRACT

The apparatus or "chiller" uses an upward stream of ambient air drawn through the upright housing to cool crumb rubber particles that are deposited into and fall through the housing. The chiller includes an upright chiller housing and an array of internal baffles disposed within the lower section of the housing. Crumb rubber deposited into the chiller housing falls through the upward air flow within the chiller housing and cascades around and through the baffle array before exiting the chiller. The baffle array inside the lower section of the chiller housing slows the fall of the crumb rubber, thereby increasing the dwell time through the chiller to provide enhanced cooling. The baffle array also creates a more turbulent air flow through which the crumb rubber falls. The rising turbulent air mass enhances the transfer of thermal energy from the falling crumb rubber.

13 Claims, 3 Drawing Sheets

COOLING APPARATUS USED IN RECYCLING SCRAP TIRES

This invention relates to an apparatus used in the tire recycling process, and in particular an apparatus for cooling chipped tires, crumb rubber or other types of granular materials.

BACKGROUND OF THE INVENTION

Scrap automotive and truck tires can be recycled into chipped tires (large wire-free shredded chunks) or crumb rubber (fine wire free granular particles). Scrap tires are generally processed into crumb rubber either by the use of cryogenic reduction processes or by mechanical grinding. Cryogenic reduction processes consist of freezing the shredded rubber at an extremely low temperature (far below the glass transition temperature of the rubber), then shattering the frozen rubber into small particles. The cryogenic reduction process is clean and fast, and produces a crumb rubber of a fine mesh size, but is more costly than mechanical grinding. Mechanical grinding consists of mechanically breaking down the rubber into small particles using grinding apparatus, called cracker mills. Cracker mills are well established and can produce crumb rubber of varying particle size, grades and quality at relatively low cost. In the mechanical grinding process, material may be passed through a cracker mill in order to achieve the desired particle size.

In the recycling process, whether using cryogenic or mechanical processes, metal wires and non-metallic fibers (fluff), dust, glass and other debris are removed as the tires are shredded into chipped tires and ground into crumb rubber. Steel fibers are removed using a magnetic separator, sieve shakers, centrifuges, and other mechanisms. Fluff, dust and other debris are separated from the ground crumb rubber by air classifiers or other separation equipment.

The mechanical process of shredding tires into chipped tires and grinding chipped tires into crumb rubber generates considerable heat. Often the temperature of the crumb rubber coming out of a cracker mill reaches the vulcanization temperature of the rubber, where the rubber melts rather defeating the grinding process. Consequently, the crumb rubber coming out of cracker mills must cool before it can be further ground in additional passes through a cracker mill. Air classifiers, and other separators used in the recycling process provide some cooling, but generally are insufficient to cool the crumb rubber so that it can be immediately ground again.

SUMMARY OF INVENTION

The present invention provides an apparatus or "chiller" that uses an upward stream of ambient air drawn through the upright housing to cool crumb rubber particles that are deposited into and fall through the housing. The chiller includes an upright chiller housing and an array of internal baffles disposed within the lower section of the housing. Crumb rubber deposited into the chiller housing falls through the upward air flow within the chiller housing and cascades around and through the baffle array before exiting the chiller. The baffle array inside the lower section of the chiller housing slows the fall of the crumb rubber, thereby increasing the dwell time through the chiller to provide enhanced cooling. The baffle array also creates a more turbulent air flow through which the crumb rubber falls. The rising turbulent air mass enhances the transfer of thermal energy from the falling crumb rubber.

The present invention provides an apparatus that effectively cools chipped tires and crumb rubber in a single pass to temperatures sufficient for immediate reprocessing. The apparatus offers an effective air cooling of chipped tires and crumb rubber and can be readily incorporated into existing material handling, grinding and filtering systems used in the recycling of scrap tires and similar products. In addition, the present invention can be used to cool other types of granular particles in other process applications.

These and other advantages of the present invention will become apparent from the following description of an embodiment of the invention with reference to the accompanying drawings.

BRIEF DESCRIPTION OF THE DRAWINGS

The drawings illustrate an embodiment of the present invention, in which:

FIG. 2 is a side view of the chiller of FIG. 1 having a portion cut away to show the air flow and material flow there through; and FIG. 3 is a front view of the chiller of FIG. 1 having portions cut away to show the air flow and material flow there through.

DESCRIPTION OF THE PREFERRED EMBODIMENT

Figure 1:
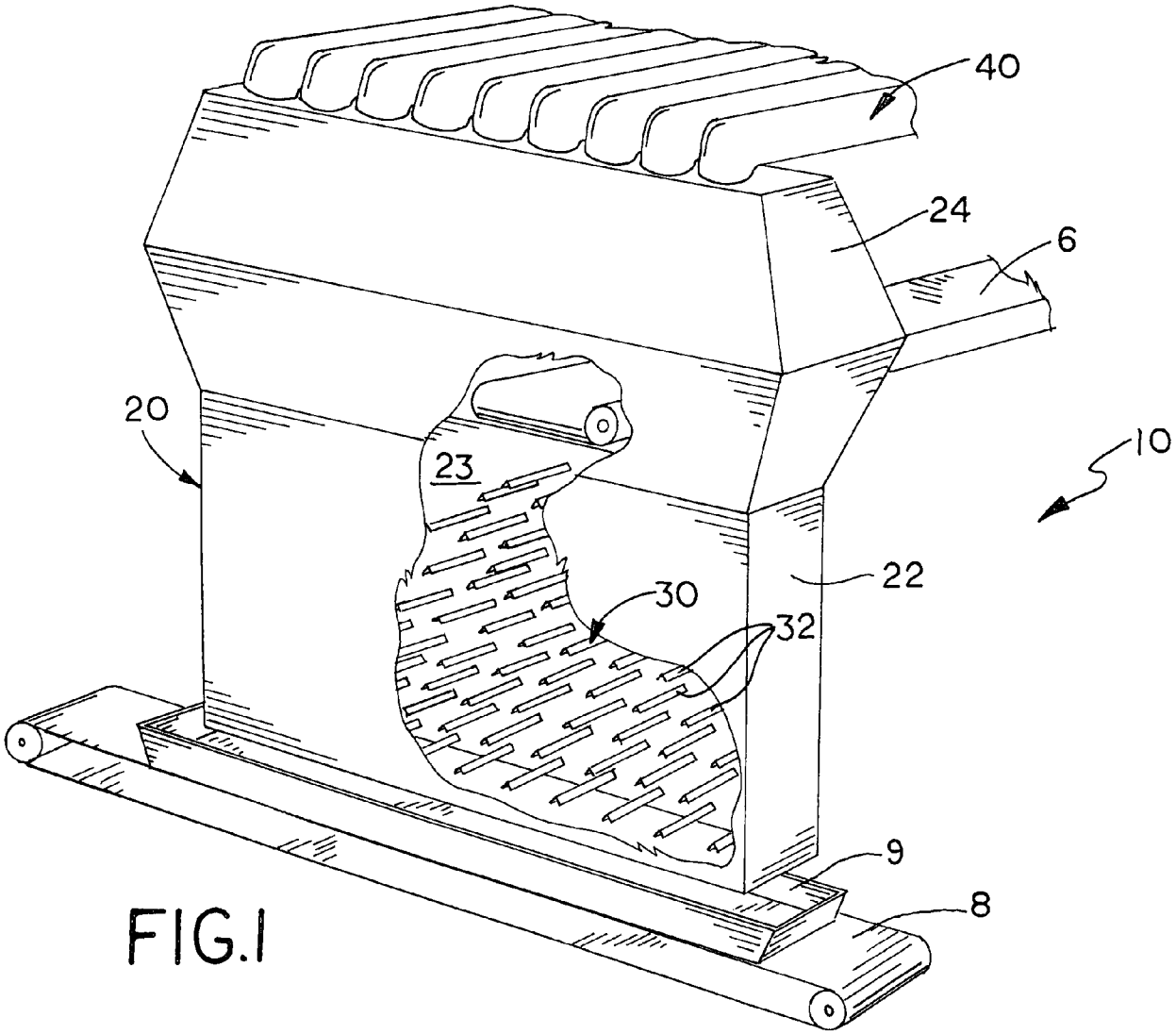
FIG. 1 is a perspective view of an embodiment of the chiller of this invention having a portion cut away to show the baffle array.
Figure 2:
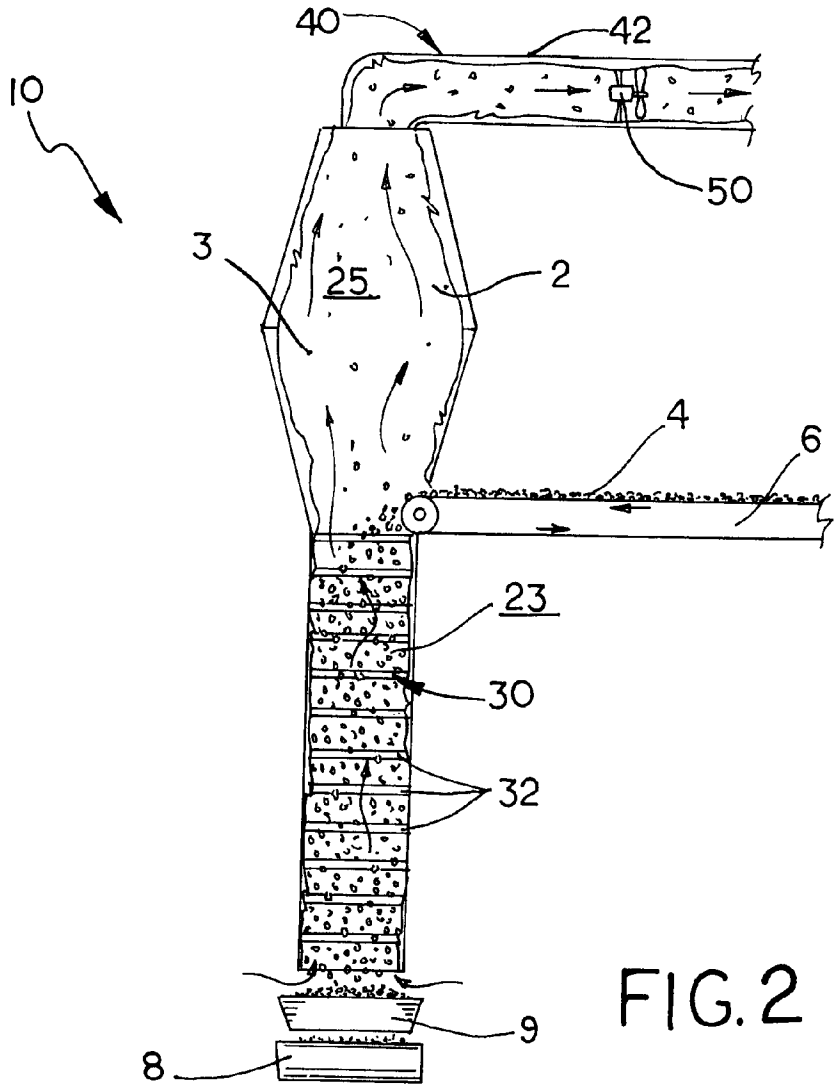
Figure 3:
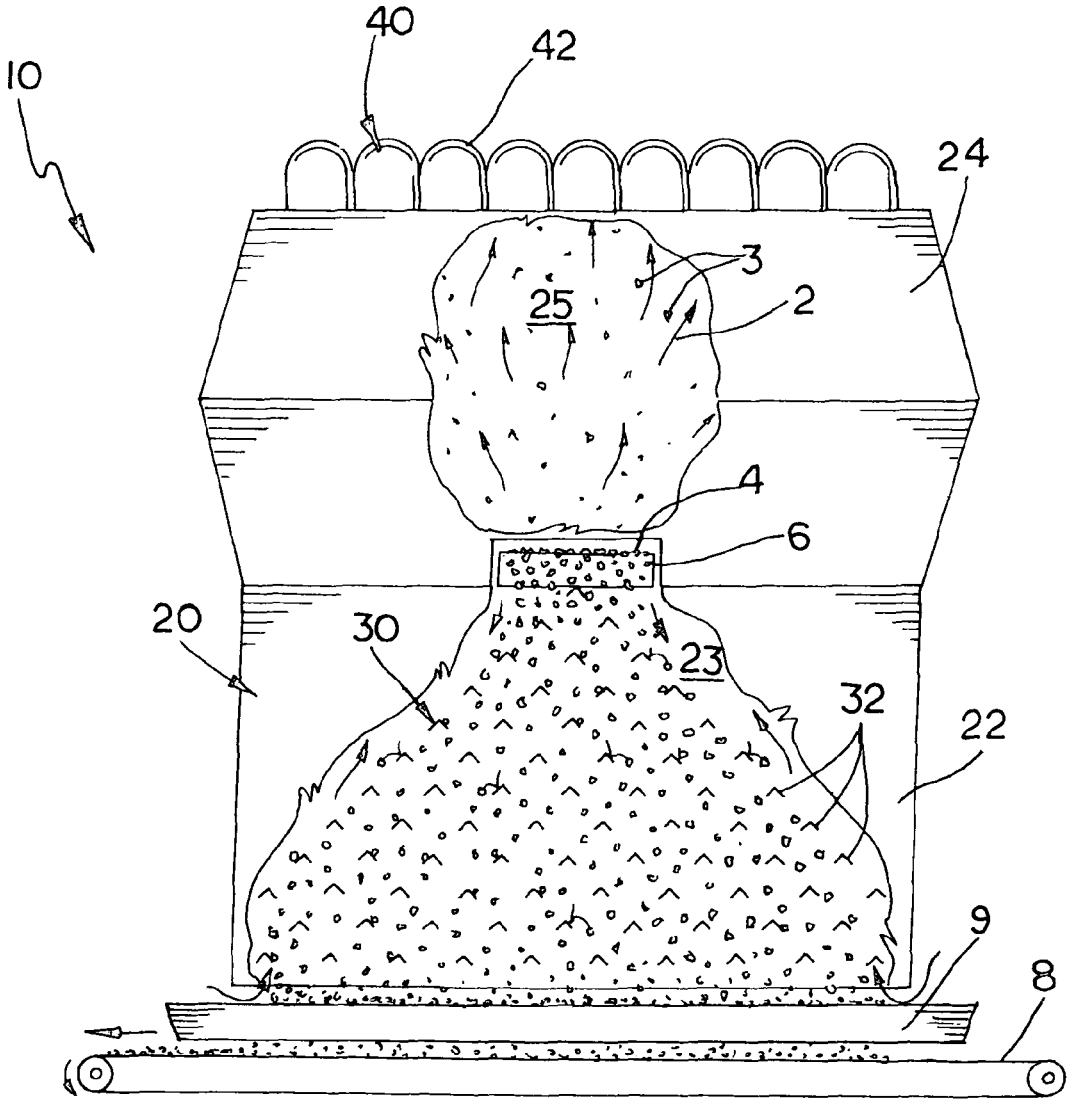

Referring now to the drawings, FIGS. 1-3 illustrate an embodiment of the crumb rubber chiller of this invention, which is designated generally as reference numeral 10. Chiller 10 air cools crumb rubber conveyed directly from a cracker mill so that it can be immediately further ground and processed. While this embodiment of the invention is specifically designed and intended to air cool crumb rubber in a tire recycling process, the teachings of this invention may be adapted and applied to air cool other granular materials in other processes and applications.

In the embodiment illustrated in the drawings and described hereinafter, conventional belt conveyers 6 and 8 are used to transport crumb rubber to and from chiller 10. Input conveyer 6 deposited the initial crumb rubber to be cooled into chiller 10 and output conveyer 8 carries away the cooled crumb rubber falling from chiller 10 for further processing. Conveyers 6 and 8 are of conventional design for moving granular particles, such as crumb rubber, and are commonly known and understood by those in the art. Although belt conveyers are illustrated and described herein, other suitable mechanical and pneumatic material transport means, may be employed in other embodiments of this invention as desired for each cooling process application.

As shown, chiller 10 includes an upright housing 20 and an air flow system 40 that draws air flow upward through the housing. Chiller housing 20 has a rectangular lower section 22, which defines a lower plenum chamber 23 and a trapezoidal upper section 22, which defines an upper plenum chamber 25. It should be noted that the volume of upper plenum chamber 25 is larger than the volume of lower plenum chamber 23. Lower housing section 22 has an open bottom 21, through which the cooled crumb rubber falls. A rectangular chute 9 is typically positioned between the material output conveyer and the bottom of chiller 10 to guide the material onto output conveyer 8. Chiller housing 20 also has a side input opening 27 between lower section 22 and upper section 24, through which the initial crumb rubber to be cooled is deposited into chiller housing 20 from input conveyers 6.

Chiller housing 20 also includes a plurality of internal baffles 32 disposed within the lower plenum chamber 23. Baffles 32 are arranged in a stager, vertically and horizontally spaced array 30. Each baffle 32 is a length of equal legged angle iron transversely mounted between the side walls of lower section 22 within plenum chamber 23. As shown, each baffle is oriented so that each of the legs slope downward. Although this embodiment of the invention uses lengths of angle iron as baffles in the array, tubes, plates and other structures may be used as baffles in additional embodiments of the present invention.

Air flow system 40 generally includes one or more fans or blowers 50 that pull air through a plurality of ducts 42 connect an upper section 24 of chiller housing 20. Fans 50 are of conventional design, well known in the industry. The type and size of fans 50 are selected to provide the desired volume of air through chiller housing 20 at the desired velocity. Air flow system 50 may be a separate system apart form chiller housing 20 (as shown), or integrated as part of chiller housing 20.

In operation, crumb rubber to be cooled is deposited or metered into chiller housing 20 through side opening 27 on input conveyer 6. The deposited crumb rubber 4 falls through lower plenum chamber 23 cascading over and through baffle array 30 as ambient air 2 is drawing upward through the plenum chamber by air flow system 40. The upward flow of ambient air cools the crumb rubber as it falls through the plenum chamber 21. The falling crumb rubber cascades through and around baffle array 30, which slows the flow of crumb rubber through the plenum chamber, increasing its dwell time within the plenum chamber. The "apex up" orientation of baffles 32, that is the angle iron, ensures that the crumb rubber particles bounce and deflect randomly off the baffles thereby breaking up the flow of the falling crumb rubber particles, without allowing any particles to be trapped within chiller housing 20. It should also be noted that the velocity of the air flow through chiller housing 20 slows exiting the lower plenum chamber 23 and entering the larger upper plenum chamber 25. Slowing the air flow within upper housing section 24 helps prevent the small particles of crumb rubber from being blown upward and lost in the air flow system or any filtration works incorporated into the chiller and/or air flow system. Slowing the air flow through upper plenum chamber also allows any fluff and dust remaining in the crumb rubber to be pulled upward with the air flow and filtered or collected by a filtration system (not shown) in the air flow system. The particles of crumb rubber, being heavier than the fluff eventually cascades through baffle array 30 of lower section 22 onto output conveyer 4, which carries the cooled crumb rubber away for further processing.

One skilled in the art will note several advantages of the present invention. The chiller of this invention offers an effective air cooling of crumb rubber and can be readily incorporated into existing material handling, grinding and filtering systems used in the recycling of scrap tires and similar products. The chiller embodying the present invention can cool chipped tires and crumb rubber in a single pass to sufficient temperatures that allow the cooled particles to be immediately reprocessed or further ground. The chiller uses an upward air stream drawn through the chiller housing to cool the crumb rubber that is deposited into and falls through the housing. The baffle array inside the lower section of the chiller housing slows the fall of the crumb rubber, thereby increasing the dwell time through the chiller to provide enhanced cooling. The baffle array also creates a more turbulent air flow through which the crumb rubber falls. The rising turbulent air mass enhances the transfer of thermal energy from the falling crumb rubber. The configuration and larger volume of the upper housing section help slow the air flow through the upper plenum chamber to prevent the loss of crumb rubber into the air flow system while allowing lighter fluff and dust to be carried upward for filtration.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. An apparatus for cooling granular particles comprising:

an upright housing defining an interior thereof, the housing having an open bottom end, and a side opening therein through which granular particles are deposited into the housing interior; the housing includes an array of spaced baffles mounted within the housing interior below the side opening, the housing includes the housing having a lower section defining a lower plenum chamber and an upper section, the upper section defines an upper plenum chamber having a volume greater than the lower plenum chamber, the side opening disposed between the lower section and the upper section;

air flow means operatively connected to the housing for drawing ambient air upward through the housing interior from the bottom end in a path through the housing interior such that the ambient air passes through falling granular particles from the bottom end to a point where the granular particles enter the housing interior from the side opening and then flows out of the housing interior, whereby the granular particles deposited into the housing interior fall through the housing interior cascading through the array of baffles as the ambient air is drawn through falling granular particles and the housing interior; and wherein the housing is configured and arranged such that the granular particles flow in a downward path from the side opening, the particles deflecting off of the array of baffles and passing through the lower plenum chamber and exiting the housing through the open bottom end; and wherein the lower section is substantially filled with the array of baffles.

2. The apparatus of claim 1 wherein the lower section is rectangular and the upper section is trapezoidal.

3. The apparatus of claim 1 wherein the air flow means includes a fan.

4. The apparatus of claim 1 wherein the array of baffles is mounted within the lower plenum chamber of the lower section.

5. The apparatus of claim 1 wherein each of the baffles of the array of baffles is a length of angle iron.

6. The apparatus of claim 1, further comprising an input conveyor configured and arranged to convey the granular particles into the housing through the side opening.

7. An apparatus for cooling crumb rubber from recycled tires, the apparatus comprising:

an upright housing defining an interior thereof, the housing having an open bottom end, the housing having a lower section defining a lower plenum chamber and an upper section, the upper section defines an upper plenum chamber having a volume greater than the lower plenum chamber; and a side opening therein through which the crumb rubber is deposited into the housing interior, the side opening disposed in a midportion of the housing; the housing includes an array of spaced baffles mounted within the housing interior below the side opening;

a blower operatively connected to the housing for drawing ambient air upward through the housing interior from the bottom end in a path through the housing interior such that the ambient air passes through falling crumb rubber from the bottom end to a point where the crumb rubber enters the housing interior from the side opening and then flows out of the housing interior, whereby the crumb rubber deposited into the housing interior falls through the housing interior cascading through the array of baffles as the ambient air is drawn through falling crumb rubber and the housing interior; and wherein the housing is configured and arranged such that the crumb rubber flows in a downward path from the side opening, the crumb rubber deflecting off of the array of baffles and passing through the lower plenum chamber and exiting the housing through the open bottom end; and wherein the lower section is substantially filled with the array of baffles.

8. The apparatus of claim 7 wherein the lower section is rectangular and the upper section is trapezoidal.

9. The apparatus of claim 7 wherein the blower comprises a fan.

10. The apparatus of claim 7 wherein the array of baffles is mounted within the lower plenum chamber of the lower section.

11. The apparatus of claim 7 wherein each of the baffles of the array of baffles is a length of angle iron.

12. The apparatus of claim 7, further comprising an input conveyor configured and arranged to convey the crumb rubber into the housing through the side opening.

13. The apparatus of claim 7, wherein the side opening is disposed between the upper section and the lower section.

* * * * *